United States Patent [19]

Kawabata et al.

[11] Patent Number: 4,928,037

[45] Date of Patent: May 22, 1990

[54] PROTECTED DISCHARGE LAMP LIGHTING SYSTEM

[75] Inventors: Kenji Kawabata, Ome; Soichiro Ogawa, Tokyo; Ryoichi Masaki, Ome, all of Japan

[73] Assignee: Hitachi, Ltd., Tokyo, Japan

[21] Appl. No.: 286,702

[22] Filed: Dec. 20, 1988

[30] Foreign Application Priority Data

Dec. 25, 1987 [JP] Japan ..... 62-327149

[51] Int. Cl.[5] ..... H05B 37/02; H05B 41/16

[52] U.S. Cl. ..... 315/127; 315/225; 315/DIG. 5

[58] Field of Search ..... 315/127, 225, DIG. 5, 315/119

[56] References Cited

U.S. PATENT DOCUMENTS 4,554,487 11/1985 Nilssen ..... 315/127

FOREIGN PATENT DOCUMENTS 61-57500 4/1986 Japan .

*Primary Examiner*—Eugene R. LaRoche
*Assistant Examiner*—Ali Neyzari
*Attorney, Agent, or Firm*—Fay, Sharpe, Beall, Fagan, Minnich & McKee

[57] ABSTRACT

A discharge lamp lighting system including at least one switch device connected between a d.c. power supply and a discharge lamp which is turned on by a high frequency power generated through turning-on and -off of the switching device. In the discharge lighting system, the discharge lamp lighting operation is allowed to start when the d.c. power supply voltage reaches a predetermined voltage value A or over, and the discharge lamp lighting operation is stopped when the d.c. power supply voltage lowers smaller than a predetermined voltage value B, where the values A and B take a relation that B is smaller than A.

1 Claim, 1 Drawing Sheet

PROTECTED DISCHARGE LAMP LIGHTING SYSTEM

BACKGROUND OF THE INVENTION

The present invention relates to a discharge lamp lighting system, and more particularly to a circuit arrangement suitable for the system which uses a power supply with a large voltage variation.

A conventional discharge lamp lighting circuit has the fundamental arrangement as shown in FIG. 2 of Japanese Utility Model Laid-open Publication JP-U-61-57500. This circuit is generally called a push-pull inverter wherein a pair of switching devices are alternately turned on and off at the frequency determined mainly by the values of the inductance of a transformer and a resonant capacitor to convert a d.c. voltage into a high frequency a.c. voltage which is boosted by the transformer for application to the discharge lamp and for start of lighting the discharge lamp. Thereafter, the discharge lamp is maintained turned on with the help of a ballast.

The above conventional technique does not pay attention to a power supply of the type having a large voltage variation, such as a power supply obtained through rectification and smoothing of an output from a dynamo mounted on a bicycle. In particular, when the power supply voltage lowers, a voltage high enough to cause the discharge lamp to start discharge cannot be supplied, thus posing a problem of short life of the discharge lamp because a high voltage continues to be applied across the discharge lamp.

SUMMARY OF THE INVENTION

It is therefore an object of the present invention to solve the above-described problem associated with the prior art and provide a discharge lamp lighting system which does not permit the lighting operation while the power supply voltage is low, to thereby prevent the discharge lamp from being applied with high voltage and hence get rid of short life of the lamp.

The above object can be achieved by the discharge lamp lighting system of this invention wherein if a detected power supply voltage is smaller than a predetermined value A at which a lamp discharge start voltage can be obtained, the discharge lamp lighting circuit is not permitted to start operating, when the power supply voltage reaches the value A, the discharge lamp lighting circuit is allowed to start operating so that the discharge lamp is applied with a start voltage and turned on, and after turning-on and when the power supply voltage lowers smaller than a value B at which a voltage still enough to maintain stable discharge of the lamp can be obtained, the discharge lamp lighting circuit operation is stopped.

In particular, a power supply voltage is divided by resistors, and a divided voltage is applied across the base-emitter of a transistor. The dividing ratio of resistors is determined such that when the power supply voltage reaches the value A at which a lamp discharge start voltage can be obtained, the voltage applied across the base-emitter of the transistor becomes a turn-on voltage of the transistor. Therefore, when the power supply voltage reaches the value A, the transistor is made turned on and a control current is supplied to switching devices of the discharge lamp lighting circuit to start the circuit operation and turn on the lamp. A feedback loop is provided between the circuit portion from which the control current is outputted and the transistor base-emitter. Use of this feedback loop allows the voltage applied across the base-emitter after turning-on of the lamp to have a larger value than the voltage determined based on the resistor dividing ratio. As a result, a value B of the power supply voltage at which the circuit operation is still maintained can be set smaller than the value A. Thus, even if the power supply voltage varies slightly around the value A, it is possible to prevent repetitive turning-on and -off of the discharge lamp, to accordingly further avoid short life of the lamp.

DESCRIPTION OF THE PREFERRED EMBODIMENT

Figure 1:
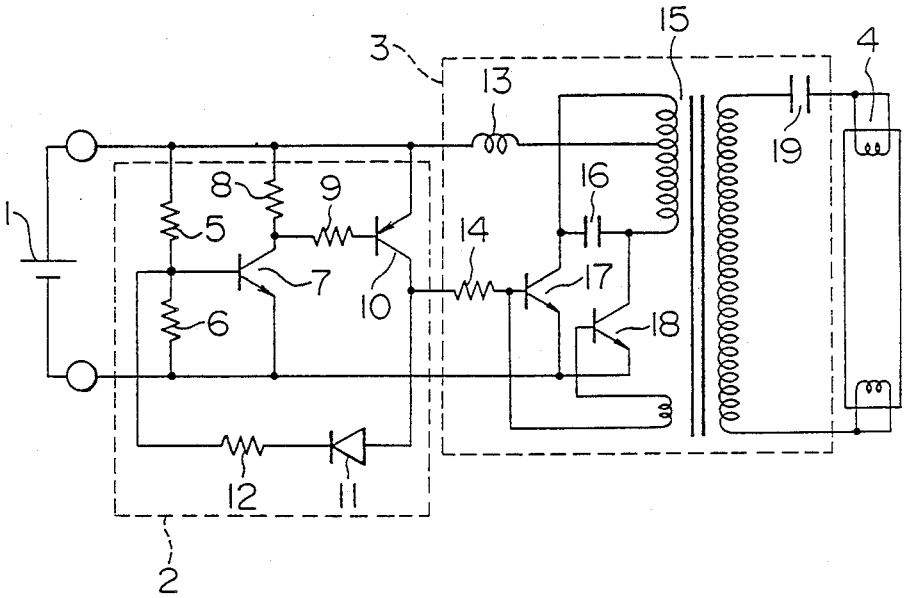
FIG. 1 is a circuit diagram of an embodiment of the discharge lamp lighting system according to the present invention.

The embodiment of the present invention will be described with reference to FIG. 1.

Referring to FIG. 1, the discharge lamp lighting system comprises a d.c. power supply 1, a lighting control circuit 2, a discharge lamp lighting circuit 3 and a discharge lamp 4. The lighting control circuit 2 comprises voltage dividing resistors 5 and 6, resistors 8 and 9, a voltage detection transistor 7, a control transistor 10, a feedback diode 11 and a feedback resistor 12. The discharge lamp lighting circuit 3 comprises a current limiting inductor 13, a transformer 15, a resonant capacitor 16, switching transistors 17 and 18, a base resistor 14, and a ballast capacitor 19.

In operation of the discharge lamp lighting circuit 3, as a base current is supplied from the base resistor to the switching transistors, one of them first starts turning on. Which one is caused to start turning on depends on a slight difference between their characteristics. The transistor first started turning on starts causing a current to be supplied via the current limiting inductor 13 and the primary winding of the transformer 15. Then, a voltage is induced across the feedback winding of the transformer 15, the polarity of the induced voltage being determined such that the transistor first started turning on goes further toward the turning-on state, and the other transistor is forced to turn off. A resonance occurs between the resonate capacitor 16 and the transformer 15 so that after a predetermined time, the voltage induced on the feedback winding is inverted and hence the turning-on and -off state of the switching transistors is also switched. Such operation is repeated to accordingly generate a high frequency voltage at the primary winding which voltage is boosted by the transformer and applied to the discharge lamp 4.

If such a condition as the power supply voltage is low, i.e., the sufficient discharge start voltage for the discharge lamp is not obtained, continues for a long time, a large electric field is applied across the discharge lamp electrodes so that they are damaged and, in an extraordinary case the lamp life becomes extremely short. In view of this, the lighting control circuit 2 controls the operation of the discharge lamp lighting circuit 3 in such a manner that the lighting circuit 3 is not permitted to operate at such a low power supply voltage, and is permitted to operate when the power supply voltage reach higher than or equal to a value A at which a discharge start voltage can be obtained.

The voltage of the d.c. power supply 1 is divided by the voltage dividing resistors 5 and 6. The divided voltage is applied across the base-emitter of the voltage detecting transistor 7. The voltage dividing ratio of the resistors 5 and 6 is determined such that when the power supply voltage reaches the value A, the voltage detecting transistor 7 is made turned on. As the voltage detecting transistor 7 turns on, a current flows therethrough via the control transistor 10 and resistor 9 so that the control transistor 10 is made turned on and hence a base current is supplied to the switching transistors 17 and 18 via the base resistor 14. Accordingly the lighting circuit 3 starts operation to turn on the discharge lamp 4.

In this condition, if the power supply voltage fluctuates around the value A, the discharge lamp 4 may repeat to turn on and off, thus resulting in short life of the lamp. In view of this, the lighting control circuit 2 is arranged not to stop the operation of the lighting circuit 3 after the lamp has once turned on unless the power supply voltage lowers smaller than the value B (where B is smaller than A).

In particular, as the control transistor 10 turns on, the feedback diode 11 also turns on to make high the voltage applied across the base-emitter of the voltage detecting transistor 7. The value of the raised voltage is determined based on the values of the voltage dividing resistors 5 and 6 and feedback resistor 12. The value B can be adjusted therefore by changing the value of the feedback resistor 12. When the power supply voltage lowers smaller than the value B, the voltage detecting transistor 7 and control transistor 10 are made turned off so that the lighting circuit 3 stops its operation. In this condition, the feedback diode 11 is made turned off again so that unless the power supply voltage goes up to the value A, the lighting circuit 3 will not start operating again.

A proper combination of values of the voltage dividing resistors 5 and 6 and feedback resistor 12 can avoid short life of the discharge lamp as described above.

As appreciated from the foregoing description of the present invention, even if a power supply with a large voltage variation such as a dynamo mounted on a bicycle is used, the life of a discharge lamp can be ensured reliably. Thus, merchandise which heretofore uses only incandescent lamps with low efficiency can use fluorescent lamps with high efficiency and long life.

What is claimed is:

1. A discharge lamp lighting system comprising:

a d.c. power supply;

a lighting circuit to which an output from said d.c. power supply is supplied and from which a high frequency voltage is generated;

a discharge lamp connected at the output side of said lighting circuit; and a lighting control circuit connected between said d.c. power supply and said lighting circuit, said lighting control circuit being constructed such that if a detected output voltage of said d.c. power supply is lower than a voltage value A at which a lamp discharge start voltage can be obtained, the operation of said lighting circuit is not allowed to start operating, when said detected output voltage reaches the voltage value A or over, said lighting circuit is caused to start operating and apply the start voltage to said discharge lamp to turn on said lamp, and after turning-on of said discharge lamp, when the output voltage of said d.c. power supply lowers smaller than a voltage value B at which said discharge lamp can still maintain its normal discharge said lighting circuit operation is stopped.

* * * * *